US008201864B2

(12) United States Patent
Wright

(10) Patent No.: US 8,201,864 B2
(45) Date of Patent: Jun. 19, 2012

(54) PUCK RETRIEVER

(76) Inventor: William Ira Wright, Brougham (CA)

( * ) Notice: Subject to any disclaimer, the term of this patent is extended or adjusted under 35 U.S.C. 154(b) by 0 days.

(21) Appl. No.: 12/929,866

(22) Filed: Feb. 22, 2011

(65) Prior Publication Data

US 2011/0210573 A1 Sep. 1, 2011

Related U.S. Application Data

(63) Continuation-in-part of application No. 12/292,429, filed on Nov. 19, 2008, now abandoned.

(51) Int. Cl.
*A63B 47/02* (2006.01)

(52) U.S. Cl. ..... 294/19.2; 473/446

(58) Field of Classification Search ..... 294/19.2; 56/332; 473/446, 471, 588
See application file for complete search history.

(56) References Cited

U.S. PATENT DOCUMENTS

| | | | | |
|---|---|---|---|---|
| 2,516,622 | A | 7/1950 | George | |
| 2,718,801 | A * | 9/1955 | Finley | 81/3.41 |
| 2,760,807 | A | 8/1956 | Watson | |
| 3,136,573 | A * | 6/1964 | Harke | 294/19.2 |
| 3,876,201 | A | 4/1975 | King | |
| 3,901,545 | A | 8/1975 | Shott | |
| 4,678,108 | A | 7/1987 | Inman | |
| 5,634,680 | A | 6/1997 | Green | |
| 5,639,133 | A | 6/1997 | Mote | |
| 5,755,632 | A * | 5/1998 | Eddy | 473/460 |
| 6,120,387 | A | 9/2000 | Bobst | |
| D478,139 | S | 8/2003 | Imig | |
| 6,719,340 | B2 | 4/2004 | Imig | |
| D580,999 | S * | 11/2008 | Mitchell | D21/721 |
| 2005/0052040 | A1 * | 3/2005 | Hellerson | 294/19.2 |

* cited by examiner

*Primary Examiner* — Dean Kramer

(57) ABSTRACT

A puck retriever has a hollow interior of diameter larger than that of a puck for use in the game of hockey. A ring of rubber or similar resiliently deformable material is located adjacent to the lower end of the tube. The ring has an inner edge which defines a circular inlet of diameter smaller than that of a puck. The ring flexes upward when pressed downward against a puck which is resting on a flat surface with resulting bending upward of the edge and enlargement of the inlet sufficient to allow the puck to pass through the inlet. The ring is of sufficient strength to resist flexing downward under the weight of any pucks within the tube such that the ring prevents pucks within the tube from exiting through the inlet. The ring may be continuous and unbroken throughout its circumference or it may be cut into a number of flaps.

5 Claims, 9 Drawing Sheets

PUCK RETRIEVER

CROSS-REFERENCE TO RELATED PRIOR APPLICATION

This application is a Continuation-in-Part of application Ser. No. 12/292,429, filed Nov. 19, 2008 now abandoned, which application claims priority pursuant to 35 USC 119 of Canadian application No. 2,611,835, filed Nov. 21, 2007, each of which applications is herein incorporated by reference in its entirety.

FIELD OF THE INVENTION

This invention relates to retrievers for picking up objects on a flat surface and more particularly to retrievers for picking up one or more pucks on a sheet of ice without the necessity of stooping or bending.

BACKGROUND OF THE INVENTION

Skill at stick-handling is essential for an athlete who participates in the sport of hockey. One of the exercises which is often used to improve an athlete's skill in this regard is to arrange a large number of pucks in a line on a sheet of ice. The athlete then hits one puck at a time into a net which is guarded by a goal tender. The goal tender attempts to block the pucks in order to prevent them from entering the net while the athlete attempts to aim the pucks where the goal tender will not be able to stop them. The exercise serve to improve the athlete's hand-eye coordination which is essential for stick-handling.

At the end of the exercise there are a number of pucks on the sheet of ice and they must be gathered from the ice and placed in a receptacle for reuse. The task of gathering the pucks requires a considerable amount of stooping or bending of the back.

U.S. Pat. No. 6,719,340 issued on Apr. 13, 2004 describes a retriever for pucks which in use, substantially eliminates the need for stooping or bending in order to gather pucks on a sheet of ice. The retriever includes an elongated tube having bristles on the inside wall adjacent to the lower end of the tube. When the tube is placed over a puck so that the bristles come into contact with it, the bristles retain the puck within the tube. A number of pucks can be picked up in this manner. The pucks within the tube form a stack until the tube is turned upside down when the pucks fall out of the open upper end of the tube.

The puck retriever described in the above patent has a number of shortcomings, one of which is that some skill and a significant amount of time are required to attach the bristles to the inside wall of the tube in such a way that they are effective for the picking up of pucks. Another shortcoming is that the bristles, with repeated use, weaken and eventually break. Once broken the puck retriever is not reliable in picking up a puck or in retaining it in the tube once it has been picked up.

The puck retriever of the subject invention substantially overcomes these shortcomings. Rubber instead of bristles is used to pick up the pucks. The rubber is in one piece and can easily and quickly be attached to the retriever. Furthermore the rubber has a much longer useful life than bristles. Repeated use of the subject retriever will have little detrimental effect on the effectiveness of the device unlike the device described in the above patent where repeated use will have a decided detrimental effect on its effectiveness.

Briefly, the puck retriever of the subject invention comprises: a tube having upper and lower ends and a hollow interior of diameter larger than that of a puck. A number of resiliently deformable flaps are formed on the lower end of the tube. The flaps have inner edges which together define a circular inlet of diameter smaller than that of the puck. The flaps flex upward when pressed downward against a puck which is resting on a flat surface with resulting enlargement of the inlet sufficient to allow the puck to pass through the inlet. The flaps however are of sufficient strength to resist flexing downward under the weight of any pucks within the tube such that the flaps prevent any pucks within the tube from exiting through the inlet.

DESCRIPTION OF THE DRAWINGS

The puck retriever of the invention is described with reference to the accompanying drawings in which.

Like reference characters refer to like parts throughout the description of the drawings.

DESCRIPTION OF PREFERRED EMBODIMENTS

Figure 1:
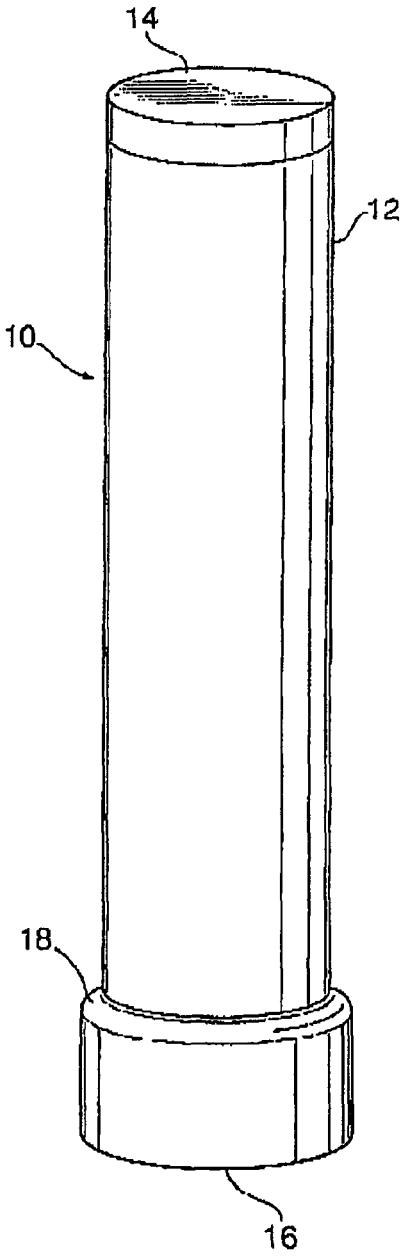
FIG. 1 is an elevation of the puck retriever.

With reference to FIG. 1, the puck retriever of the invention, generally 10, includes a tube 12 and upper and lower ends. A cap 14 is threadably attached to the upper end of the tube while, at the lower end 16, an opening is provided for entry of pucks as is described below. The tube is stepped outward at 1.8.

Figure 2:
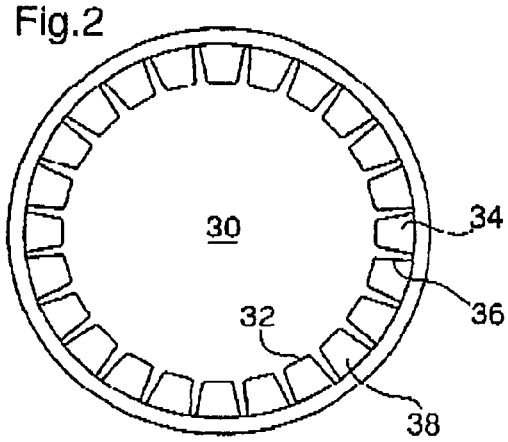
FIG. 2 is an end view of the circular inlet at the lower end of the puck retriever in larger scale than that of FIG. 1.
Figure 3:
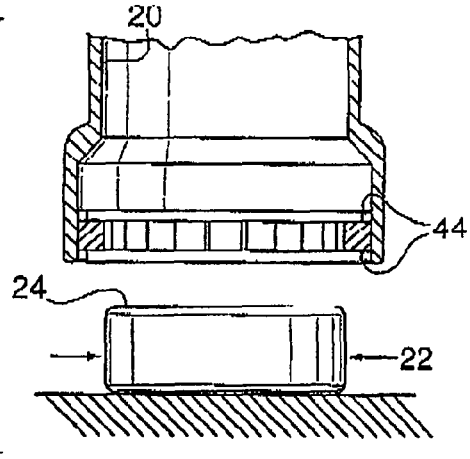
FIG. 3 is an elevation, partly in section of the lower portion of the puck retriever together with an elevation of a puck beneath the retriever.

With reference to FIGS. 2 and 3, the cylindrical interior wall 20 of the tube has a diameter that is slightly larger than the diameter 22 of puck 24 so that the puck and others like it can be accommodated within the tube.

At the lower end of the tube is a circular inlet 30 which is defined by the inner edge 32 of a ring or annulus 34. The diameter of the inlet is less than the diameter of puck 24. Accordingly when one or more pucks are within the tube, ring 34 prevents them from exiting through the inlet.

A number of radially outwardly extending slits 36 are cut in the ring. The slits define the side edges of flaps 38 which encircle the inlet.

The ring is composed of resiliently deformable material such as synthetic or natural rubber. A conventional annular rubber gasket is suitable for use as the ring and where such a gasket is used, it is retained within the tube between a pair of spaced apart annular ridges 44 on the interior wall of the tube.

Figure 4:
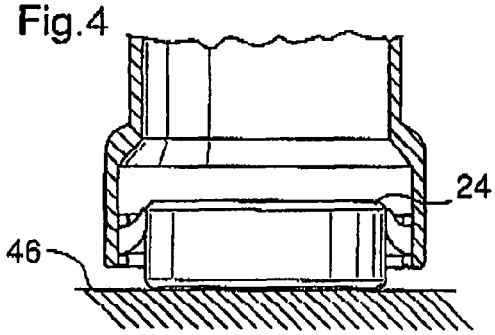
FIG. 4 is the same as FIG. 3 except that the puck is within the lower portion of the retriever.

With reference to FIG. 4, the material of which the ring is composed must be such that when the ring is pressed hard downwardly against puck 24 which is resting on a flat surface 46, the flaps flex with resulting enlargement of the diameter of the inlet sufficient to allow the puck to pass through the inlet and into the interior of the tube. The material must not however be so flexible that the flaps flex when less than a hard force is applied to them. They must not, for example, flex under the weight of the pucks within the tube. Rather, they must remain rigid at this time to prevent the pucks from discharging through the bottom of the tube.

The flaps accordingly prevent any pucks within the tube from discharging through the inlet but allow pucks to enter the tube from below. The only way that the pucks can be removed from the tube is by turning the tube upside down and removing nap 14 so that the pucks will fall outwardly of the tube through the open upper end of the tube.

Figure 5:
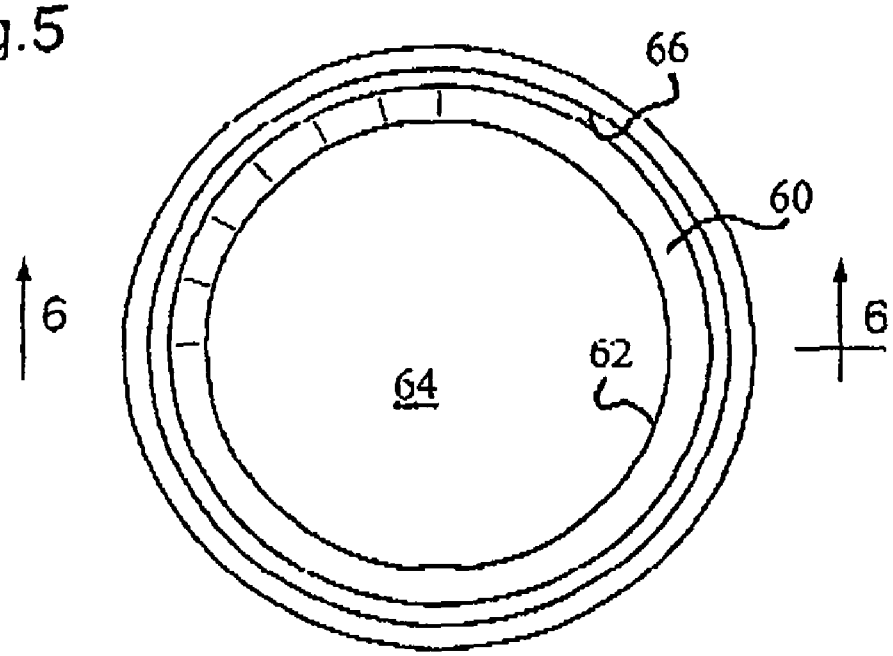
FIG. 5 is an end view of the inlet of a second embodiment of the puck retriever.
Figure 6:
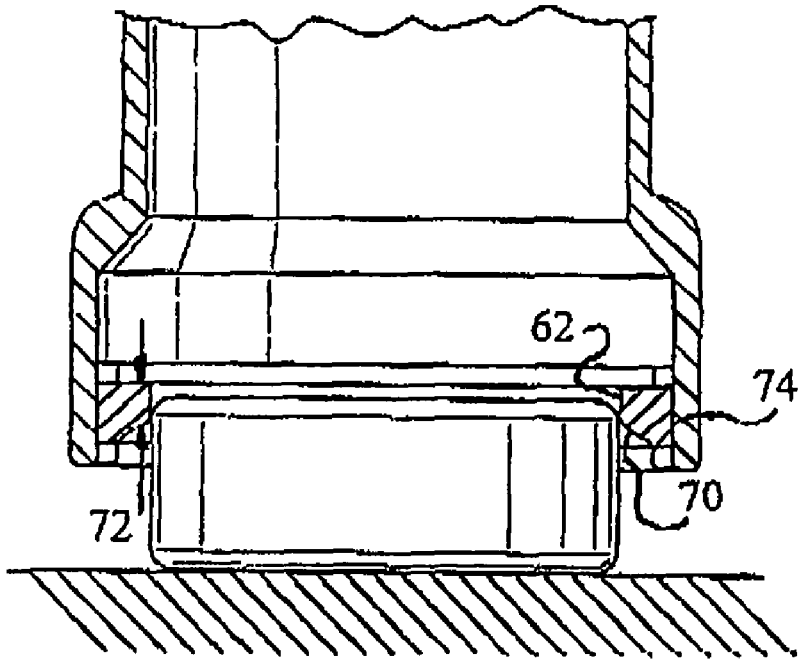
FIG. 6 is partly an elevation and partly a section on line 6-6 of FIG. 5.

With reference to FIGS. 5 and 6, ring 60 is the same as ring 34 of the previous figures except that the ring is free of slits and flaps. Rather the ring is continuous and unbroken throughout its circumference. The inner edge 62 of the ring is circular and defines a circular inlet 64 of diameter smaller than that of a puck. As with ring 34, ring 60 flexes upward when pressed downward against a puck which is resting on a flat surface with resulting bending upward of the edge and resulting enlargement of the inlet sufficient to allow the puck to pass through the inlet. The ring is however of sufficient strength to resist flexing downward under the weight of any pucks within tube 66 such that the ring prevents the pucks from exiting through the inlet.

As seen in FIG. 6, the lower wall 70 of the ring is bevelled such that the thickness of the ring, indicated 72, is least at its inner edge 62 and enlarges radially outward of the inner edge to a maximum adjacent to its outer edge 74. A bevelled lower wall is advantageous because it directs a puck that is being retrieved from a sheet of ice to the inlet of the retriever. Pucks within the retriever however are not directed to the inlet since the upper surface of the ring is not bevelled.

Figure 7:
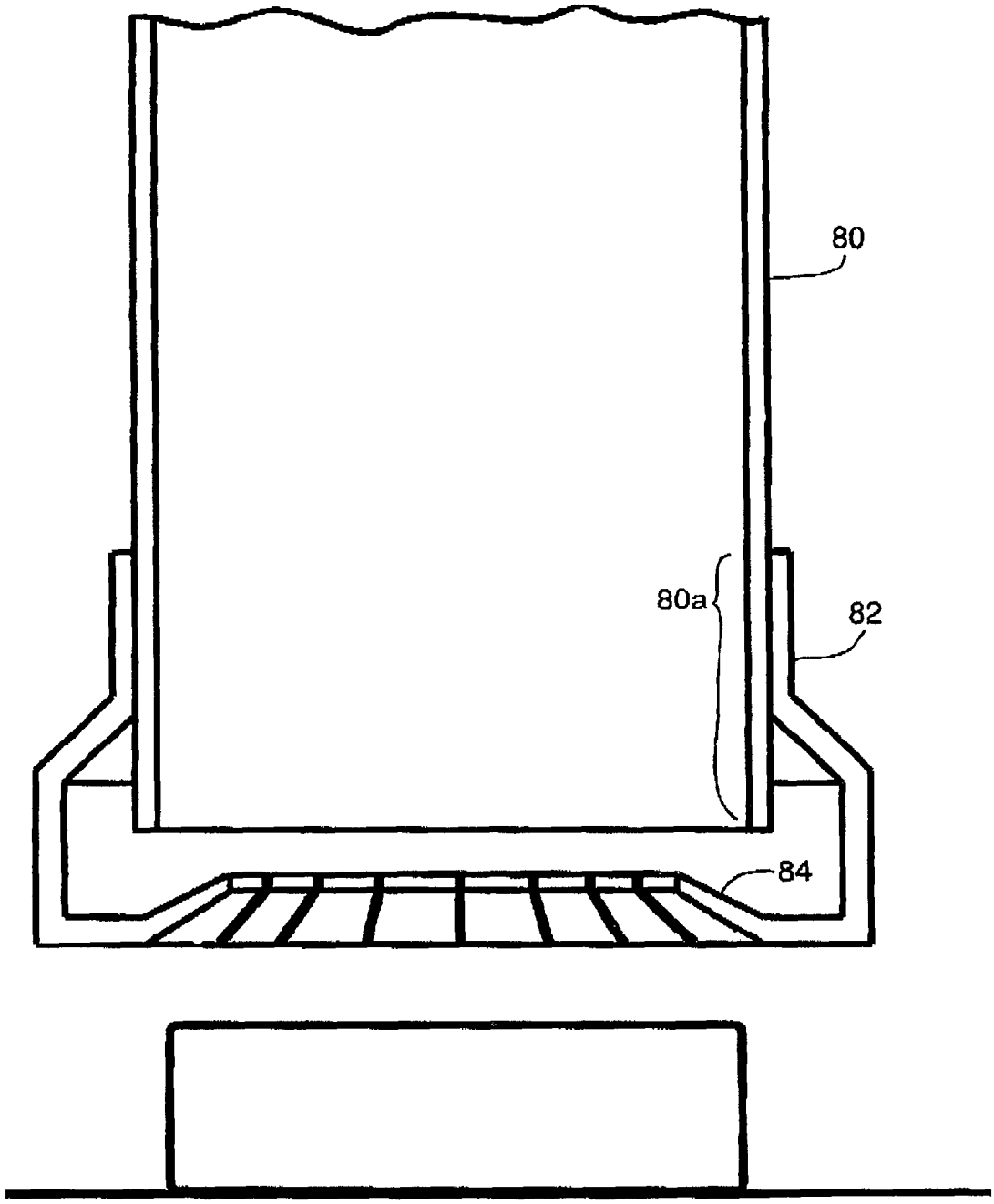
FIG. 7 is a section of the lower portion of a third embodiment of the puck retriever in conjunction with a puck. This figure and the remaining figures are in larger scale than the previous figures.
Figure 8:
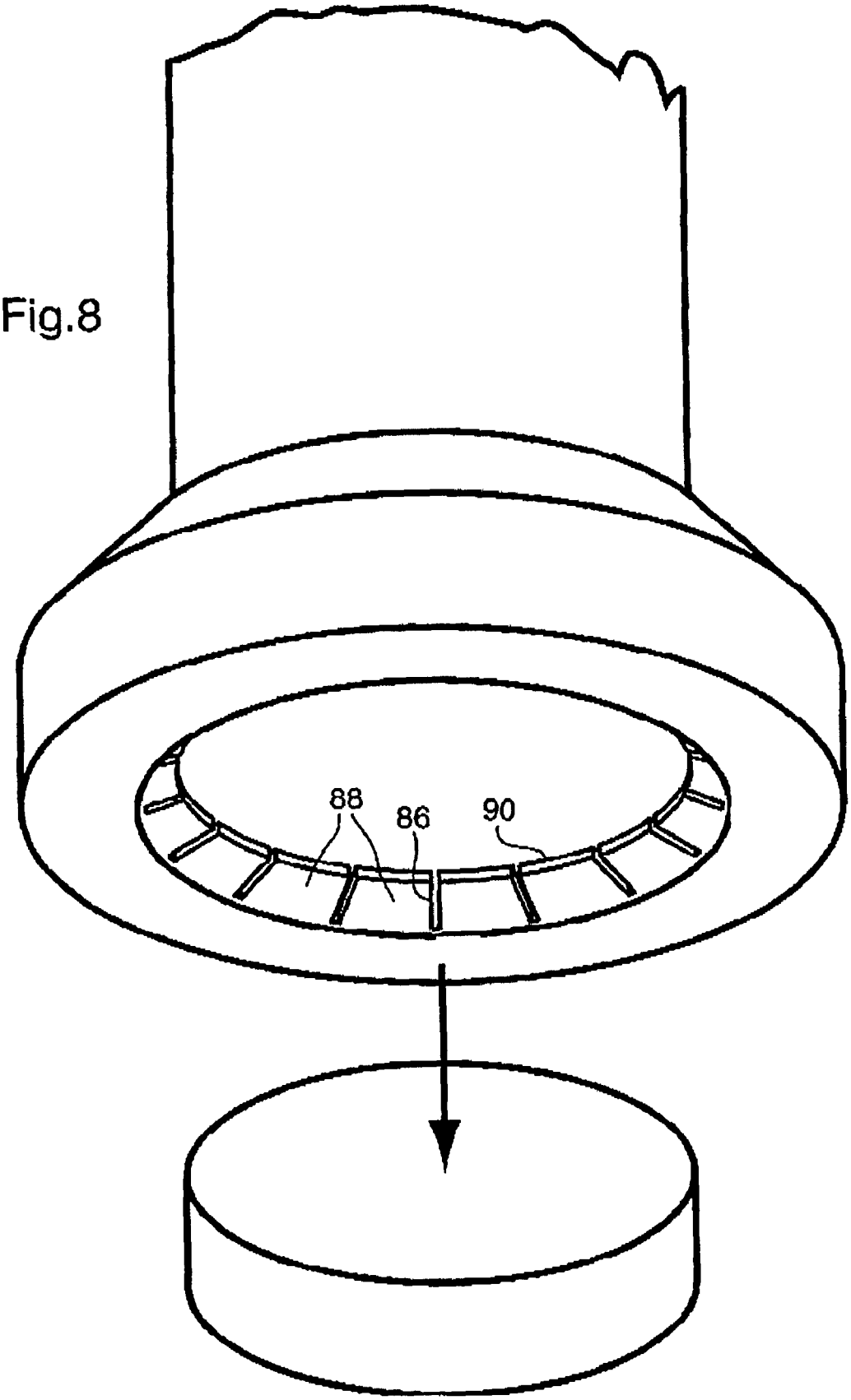
FIG. 8 is a perspective view of the lower portion of the third embodiment together with a puck.

With reference to FIGS. 7 and 8, the puck retriever consists of a tube 80 and a cap 82. The cap is friction-fitted to the tube and encircles and encloses the lower end portion 80*a* of the tube. An annulus 84 is formed in the lower wall of the cap. The annulus is continuous and unbroken throughout its circumference save and except for a number of radially extending slits 86 around its circumference. The slits, like those of the puck retriever of FIG. 2, define side edges of a plurality of flaps 88 and the flaps have inner edges 90 which define a circular inlet of diameter smaller than that of a puck. Flaps 88 also, like flaps 38 illustrated in FIG. 2, flex upward when pressed downward against a puck resting on a flat surface. Upward flexure of the flaps results in enlargement of the inlet sufficient to allow a puck to pass through the inlet.

Figure 9:
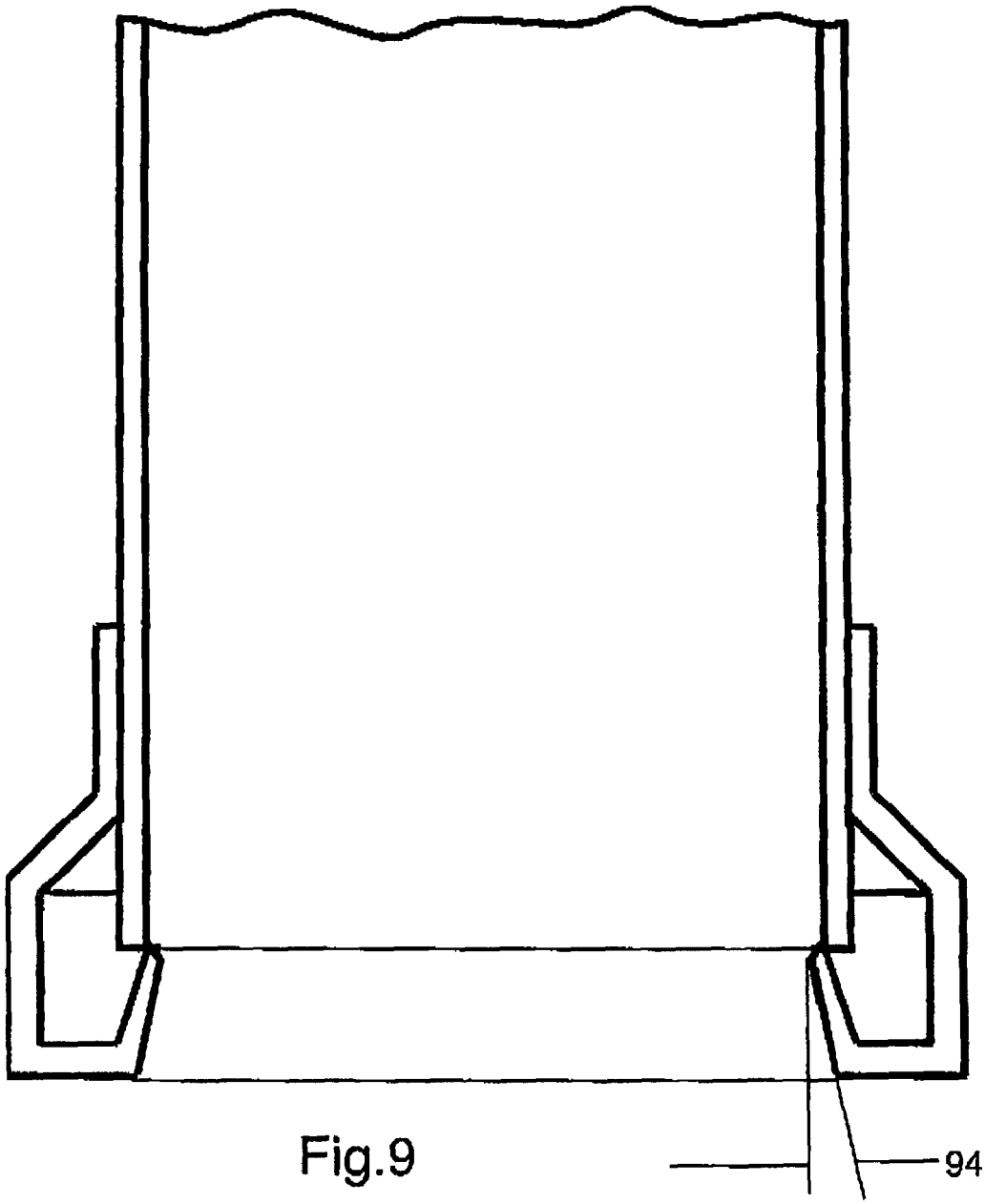
FIG. 9 is a section of the lower portion of the third embodiment of the invention.

Flaps 88 differ from the flaps of FIG. 2 however, in that, as illustrated in FIGS. 7 and 9, they are normally inclined upward and radially inward of the circumference of the annulus when undeformed by a puck. The angle 94 of the flaps relative to the vertical when the puck-retriever is upright is in the range of approximately 40 and 60 degrees and preferably approximately 50 degrees. When inclined at this angle, the flaps flex or bend less when pressed onto a puck than the flaps of FIG. 2. As a result, the flaps of FIGS. 7-9 grip a puck more firmly aver more extended period of time than the flaps of FIG. 2 which bend much more when pressed onto a puck.

As previously indicated, the flaps of FIG. 7, when the puck retriever is upright, are normally angled upward and radially inward of the circumference of the annulus when undeformed by a puck. When the flaps are pressed downward against a puck, they deform resiliently and flex further upward. As with the annulus of FIG. 2, the annulus of FIG. 7 is of sufficient strength to resist flexing downward under the weight of any pucks within the tube such that the annulus prevents the pucks from falling out of the tube as pucks are collected by the device.

Figure 10:
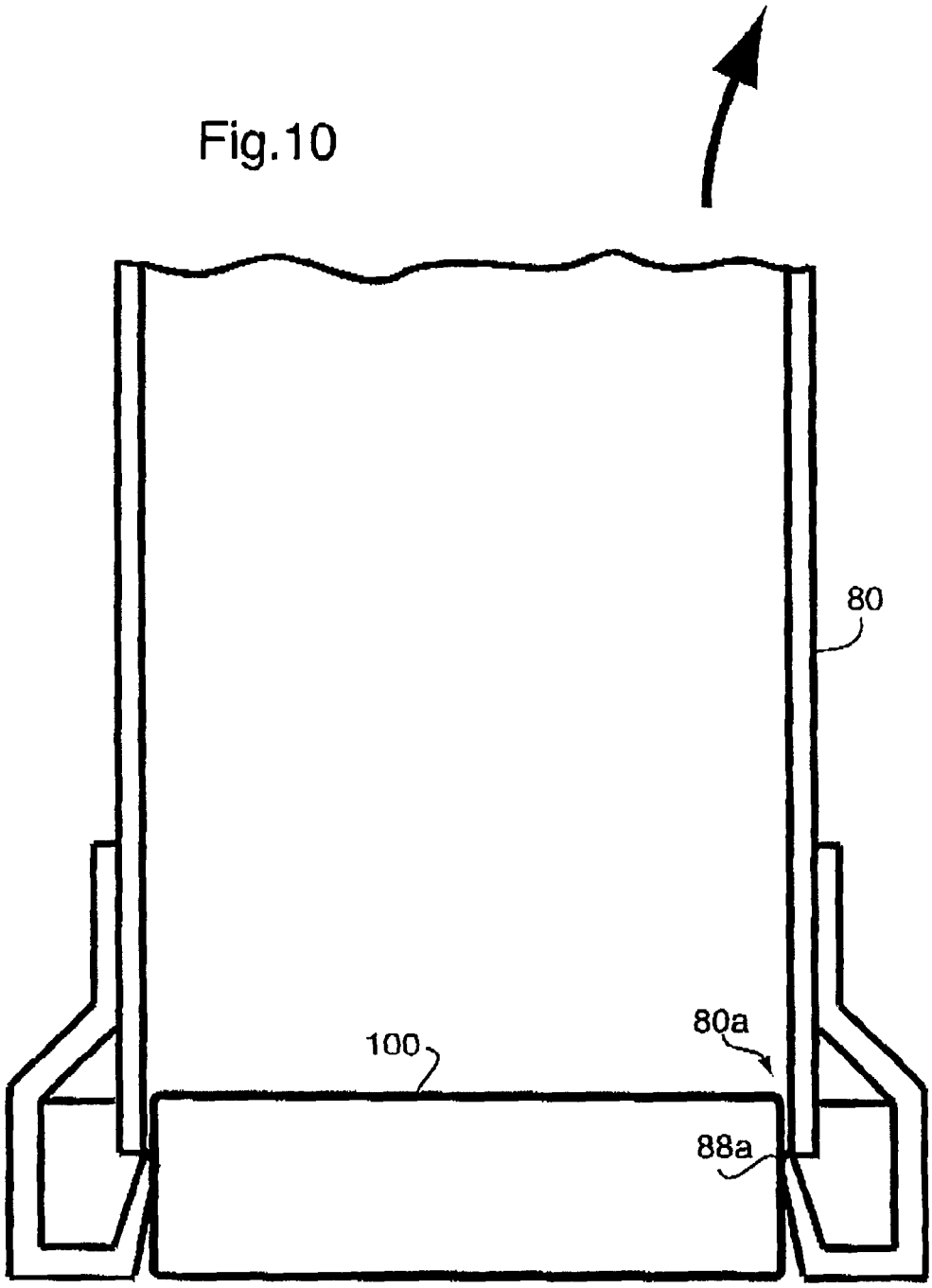
FIG. 10 is a section as in FIG. 9 together with a puck.

With reference to FIG. 10, the lower portion of tube 80 is dimensioned such that the upper edges 88*a* of the flaps come into contact with the lower portion when flexed upward by puck 100. The lower portion of the tube serves two functions: to limit the extent of upward flexing of the flaps; and to cause the flaps to apply inward pressure on the puck. The lower portion of the tube accordingly locks the puck to the flaps and prevents it and any above it from falling out of the tube.

Figure 11:
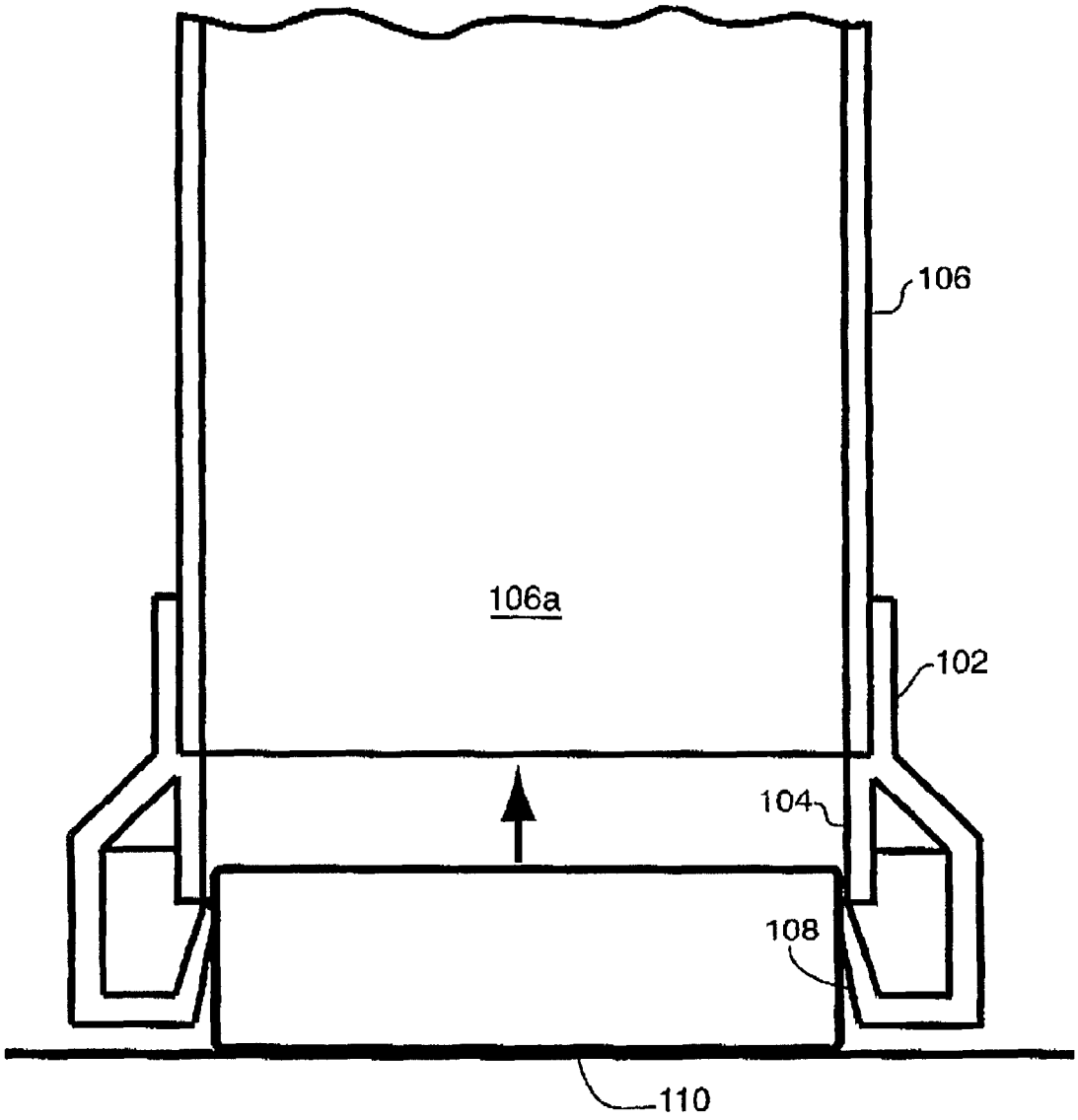
FIG. 11 is a section of the lower portion of a fourth embodiment of the puck retriever in conjunction with a puck.

The puck retriever of FIG. 11 is the same as that illustrated in FIGS. 7-10 except that cap 102 has an inner cylindrical wall 104 which opens into the hollow interior 106*a* of the tube. The cylindrical wall serves the same function as the lower portion 80*a* of lube 80, namely to limit the extent of upward flexing of flaps 108 and to cause the flaps to apply inward pressure on puck 110 to prevent a puck from falling from the cylinder once the flaps are in contact with the cylindrical wall.

Figure 12:
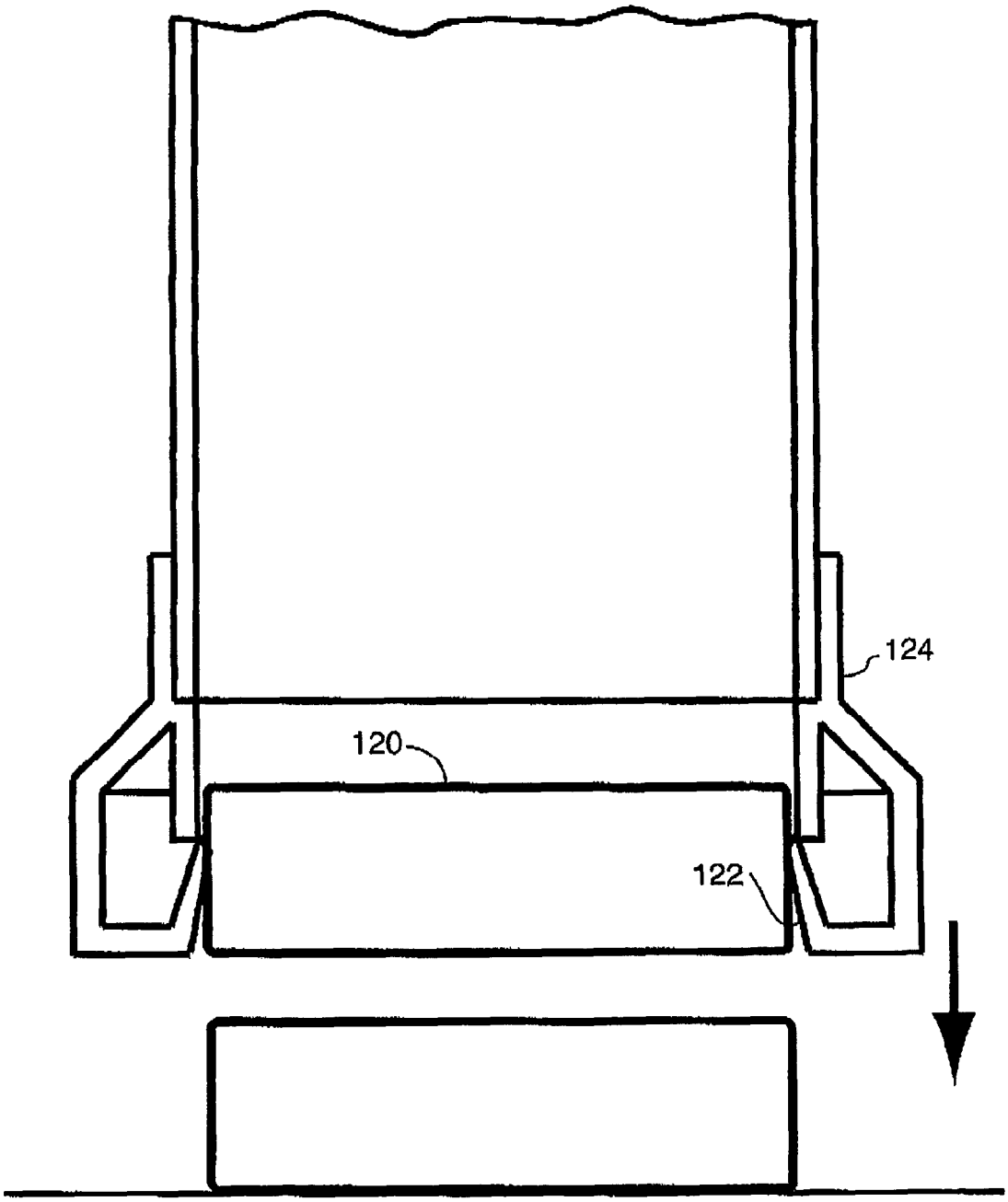
FIGS. 12 and 13 are sections of the fourth embodiment together with two pucks.
Figure 13:
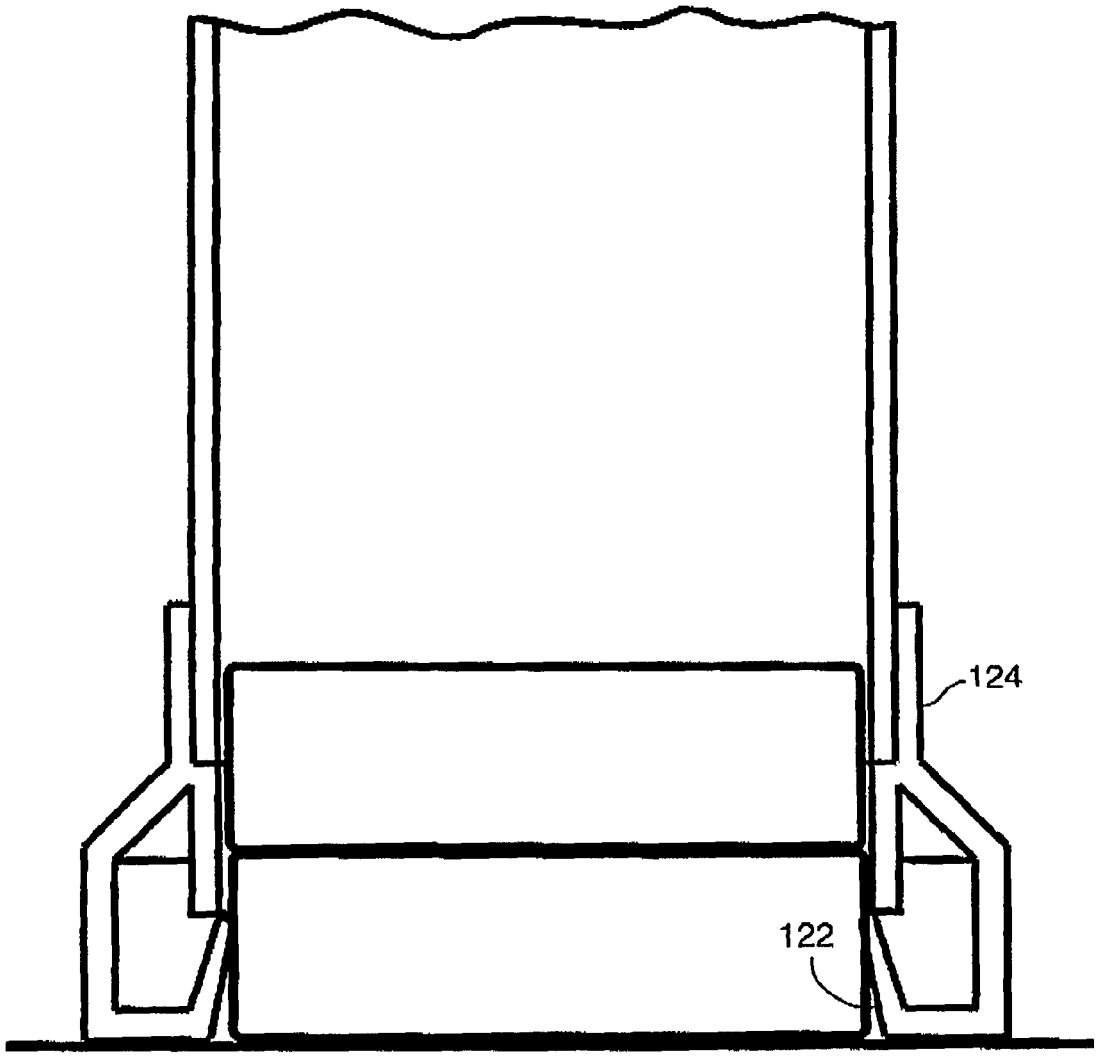

In FIG. 12 a puck 120 is within the puck retriever and is held there by flaps 122 at the bottom of cap 124. A second puck is added to puck 120 in the retriever by placing the device over the puck and pressing the device downward as illustrated in FIG. 13 until the bottom wall of cap 124 contacts the ground. Flaps 122 will grip the second puck and hold it to the retriever It will be understood, of course, that modifications can be made in the structure of the various embodiments of the puck retriever of the invention described in this application without departing from the scope and purview of the invention as defined in the appended claims.

I claim:

1. A puck retriever comprising: a tube for pucks for use in the game of hockey, said tube having a hollow interior of diameter larger than that of a puck and an opening at a lower end portion of said tube for receipt of one said puck at a time into said interior; a cap mounted to said lower end portion of said tube, said cap having a cylindrical wall which opens into said hollow interior of said tube and an annulus beneath said cylindrical wall when said puck retriever is upright, said annulus being continuous and unbroken throughout its circumference save and except for a plurality of radially extending slits spaced around its circumference, which said slits define side edges of a plurality of flaps, said flaps having inner edges which define a circular inlet of diameter smaller than that of said puck, said flaps flexing upward when pressed downward against a puck which is resting on a flat surface with resulting bending upward of said flaps and enlargement of said inlet sufficient to allow a puck to pass through said inlet, said annulus being of sufficient strength to resist flexing downward under the weight of any pucks within said tube such that said annulus prevents the latter said pucks from exiting through said inlet, said flaps, when said puck retriever is upright, being normally angled upward radially inward of the circumference of said annulus when undeformed by a puck and, when pressed downward against a puck, deforming resiliently and flexing further upward into contact with said cylindrical wall of said cap with resulting limitation of the extent of upward flexing of said flaps as well as inward pressure upon a puck by said flaps.

2. The puck retriever of claim 1 wherein the angle between said flaps and the vertical when said puck retriever is upright is in the range of approximately 40 and 60 degrees.

3. The puck retriever of claim 1 wherein the angle between said flaps and the vertical when said puck retriever is upright is approximately 50 degrees.

4. The puck retriever of claim 1 wherein said annulus is composed of synthetic or natural rubber.

5. The puck retriever of claim 1 wherein said flaps have a thickness which is least at said inner edges and enlarge radially outward of said inner edges.

* * * * *